US005371344A

United States Patent [19]

Buie et al.

[11] Patent Number: 5,371,344

[45] Date of Patent: Dec. 6, 1994

[54] CASH DRAWER

[75] Inventors: Robin S. Buie; Bruce L. Mann; Philip E. Stephens, all of Shelbyville, Ind.

[73] Assignee: Indiana Cash Drawer Company, Inc., Shelbyville, Ind.

[21] Appl. No.: 5,886

[22] Filed: Jan. 15, 1993

[51] Int. Cl.[5] ..... G07G 1/00

[52] U.S. Cl. ..... 235/1 R; 235/1 D; 235/7 R; 235/22

[58] Field of Search ..... 235/1 R, 1 D, 7 R, 22; 312/334.11, 334.14, 334.15, 334.12, 334.32, 334.33, 334.34

[56] References Cited

U.S. PATENT DOCUMENTS

| | | | |
|---|---|---|---|
| 2,022,385 | 11/1935 | Pasinski | 235/22 |
| 2,070,064 | 2/1937 | Pasinski | 235/22 |
| 2,517,175 | 8/1950 | Bremer | 235/22 |
| 3,301,479 | 1/1967 | Clary et al. | 235/22 |
| 4,066,308 | 1/1978 | Wedel | 312/333 |
| 4,642,449 | 2/1987 | Baitz et al. | 235/22 |
| 4,804,824 | 2/1989 | Saguchi | 235/7 R |
| 5,015,047 | 5/1991 | Nock | 312/334.11 |

FOREIGN PATENT DOCUMENTS

| | | | |
|---|---|---|---|
| 8400745 | 10/1984 | Netherlands | 312/334.11 |

OTHER PUBLICATIONS

M-S Cash Drawer Brochure (no date).
APG Cash Drawers Brochure (no date).
C & P Cash Drawer Description (no date).
MMF Industries Cashierplus Series Brochure (no date).
MMF Industries Point of Sale Cash Drawers Brochure, 1989 (no date).
CRS Cash Drawers Description, 1988 (no month).

*Primary Examiner*—Michael L. Gellner
*Assistant Examiner*—Eddie C. Lee
*Attorney, Agent, or Firm*—Ice Miller Donadio & Ryan

[57] ABSTRACT

Cash drawer system for a point-of-sale terminal having a housing, a latchable drawer, and a mechanism for forcing the drawer outward. The drawer slides on a pair of slides positioned beneath the drawer, and the drawer is latchable to the slides by latches located in the front of the drawer. Orienting features of the slide and drawer cooperate to orient the drawer for latching during drawer insertion. The drawer is also laterally movable on the slides, which prevents jamming, binding and racking of the drawer if the slides are in a non-parallel position. A central portion of the drawer may be lower than the edges to provide increased media space below a cash till.

10 Claims, 4 Drawing Sheets

CASH DRAWER

FIELD OF THE INVENTION

This invention relates to point-of-sale systems, and in particular, to a cash drawer assembly which includes a drawer, usually accommodating a till, for accessibly holding money and receipts.

BACKGROUND OF THE INVENTION

Persons who have either worked or purchased goods at any typical, established retail business understand the general concept underlying a cash drawer. A recessed or closed drawer operates as a secure depository of currency and credit card receipts until a financial transaction occurs, at which time the drawer is opened to access the contents. Many cash drawers smoothly and automatically slide open when their latch means engaging the cash drawers are opened and biasing springs push the drawer outward and open. These latches can be activated by, for instance, a solenoid receiving an electrical signal or by a mechanism connected to a cash drawer key. Other cash drawer models, both of earlier vintage as well as some produced today, must be manually pulled open. However, for many people, the most noticeable and recognizable aspect of the standard cash drawer may be the distinctive ring of a bell which often accompanies the opening of the drawer.

The simple outward appearance and function of standard cash drawers belies the complexity of their design and construction. This complexity results from the cash drawer being designed to provide operative feature; necessary for its intended use. For instance, one important feature of a cash drawer is a smooth motion of travel having minimal frictional resistance, whereby the drawer can either be automatically pushed opened at an acceptable rate by a biasing spring or alternatively be pulled open with a slight, and therefore acceptable, amount of force. To provide this feature, the drawer assembly must be precisely manufactured such that the drawer freely travels along its slides. A second important feature is easy removal of the cash drawer from its housing. Cash drawers must frequently be removed for a variety of reasons including, for example, to check that no money has accidentally slipped over the back of the drawer and into the drawer recess within the housing. To provide this feature, the cash drawer should be designed to be readily disengageable from the housing, preferably without tools.

Existing cash drawers have been designed which attempt to adequately address both these features. However, as the furthering of one feature hinders the other in most drawer slide designs, there is a limit to how much either feature can be achieved. Most cash drawers have a latch located at the upper periphery of the back of the drawer that strikes the interior front of the housing to prevent the drawer from inadvertent removal. However, this location of the latch requires one to go the cumbersome process of inserting their hand deep into the drawer and housing to reach to the back of the drawer to actuate the latch.

With regard to other design shortcomings of present cash drawers, it must be noted that the majority of cash drawer assemblies utilize slides located on each side of the cash drawer. A first slide member or rail, mounted on each side of the drawer, slidably engages a corresponding mating rail mounted within the housing. Bearing means between these rails assist their relative motion. The tighter the bearing means, which translates to less play between the slide rails and therefore in the drawer, the better the cash drawer assembly suspension and the smoother the motion of the drawer. However, proper reinsertion of the removed cash drawer into the housing is more difficult when there is little play in the slides. A more exact alignment of the rails made necessary by the tighter bearings requires that a person direct more time and effort toward the reinsertion process. Another shortcoming of this configuration is that during drawer reinsertion and the concomitant mating reengagement of the rails, the leading edge of the housing mounted rail can scar or unseat the bearings of the slide system located in the drawer mounted rail. This damage further detracts from the smoothness of drawer motion. In addition, most cash drawers are constructed such that one rail of each slide is fixedly connected to the drawer, and the drawer is removed by disengaging the connected rail from the mating rail connected to the housing. With such systems, the rail connected to the drawer sometimes protrudes from the back of the drawer. Upon reinserting the drawer back into the housing, the protruding portion is frequently inadvertently struck against the exposed front or top of the housing, resulting in unsightly dents and scratches in the finish.

A variety of manufacturing and design difficulties, some related to and others independent of the above features, continue to frustrate the current cash drawer industry in their attempts to create the most efficient design. The provision of mating slide rails respectively mounted on the drawer sides and housing sides is a common design choice of the industry, primarily to reduce material and assembly costs of manufacture while also minimizing the profile of the cash drawer assembly. This type of design is lacking in several respects. In order to provide smooth drawer travel, the slides must be mounted with tight tolerances. For example, side mounted slides allow for undesirable side to side play of the cash drawer. In addition to reducing the sturdiness of the cash drawer, cash drawer play also comprises the effectiveness of the latching means which latches the cash drawer in a closed position within the housing. Also, as the cash drawer assembly sides are subjected to a major portion of the external forces encountered during shipping and handling, the manufacturing plant quality alignment may be lost. After months or years of day-to-day use, side mounted cash drawer slides typically become misaligned. Any of these conditions can result in racking or binding, rendering the cash drawer sliding mechanism inoperable. Consequently, the slides must be properly realigned, frequently by the manufacturer, which commands a wasteful redundancy of time and effort and is therefore quite expensive.

Linear slides mounted on the bottoms of the drawer and housing, while remedying many of the shortcomings of the side mounted slides, introduce a multitude of different shortcomings for which the cost of correcting negates any advantages. Specifically, when mating rails are positioned on the housing bottom and engage bottom mounted drawer rails, unless great care is taken to ensure the slides are mounted parallel they will not slide freely and may hinder or even prevent drawer movement. Attempts to correct this shortcoming vary from exacting tolerances in manufacture, thereby avoiding the problem altogether, to providing play in the mounting of the slides to the housing by using expensive shoulder rivets. These solutions have proven mostly unsuccessful mostly due to their prohibitive labor cost and materials cost: respectively. The latter solution is also unacceptable because of its fragility and limited working life. Furthermore, because of the manner in which slide rails normally mate, bottom mounted drawer slides must be thicker in order to be sufficiently rigid to not yield under the weight of the cash drawer contents. Therefore, when such slides are used with existing cash drawers, the distance between the drawer bottom and the housing bottom is increased. As a result, the cash drawer assembly has an undesirable higher profile which decreases both its aesthetics and convenience.

In order to better serve its designated function, cash drawers usually receive a till or money tray. A till, which is a readily recognizable portion of a standard cash drawer, consists of multiple compartments appropriately sized for currency and coins. To provide for credit card receipts and bills of high denomination, tills are often designed with downwardly extending flanges at their bottom sides to create a media space between the cash drawer bottom and the till bottom for these items. When more media space is needed, the flanges are made larger or expensive brackets may be added to the till or drawer. As the credit card industry burgeons and consumers continue to opt for credit cards over cash, the need for increased media space in cash drawer assemblies is rapidly developing. Standard till designs with flanges will at some point be unable to match the demand for media space without rendering obsolete much costly equipment currently in use. Specifically, for security purposes many businesses utilize a till safe. These safes, which contain shelves of set heights for storing standard-sized cash laden tills that are not in the cash drawers, have a limit on the depth of till designs which they can accommodate. Therefore, in the future, standard cash drawers with their standard till designs may eventually become obsolete unless large expenditures of funds for modernizing complementary equipment such as till safes are appropriated by the cash drawer users.

As is apparent from the foregoing many existing cash drawers suffer from deficiencies such as the requirement of excessive labor and materials for manufacture, rail alignment degradation, and difficulty in removing a drawer from, and reinserting it into, the housing.

OBJECTS OF THE INVENTION

Accordingly, one object of the present invention is to provide a cash drawer assembly which simplifies drawer removal and reinsertion.

Another object of the present invention is to provide a cash drawer assembly wherein the complete drawer slides are mounted on the drawer housing bottom, which allows all the working parts of the cash drawer assembly to be first assembled on the housing bottom and then enclosed within a wraparound covet- providing the drawer housing sides and top, thereby decreasing the expense and expediting manufacture.

Another object of the present invention is to provide a cash drawer assembly which can be removed without tools from the complete drawer slides, mounted on the housing bottom, to which the drawer is mounted.

Another object of the present invention is to provide a cash drawer assembly wherein the drawer disengages from the entire linear slide during drawer removal, thereby reducing the likelihood of damage to the slide during drawer reinsertion.

Another object of the present invention is to provide a cash drawer assembly wherein the drawer disengages from the complete linear slide during drawer removal, thereby permitting use of a slide system having less play.

Another object of the present invention is to provide a cash drawer assembly wherein the drawer disengages from the complete linear slide during drawer removal, thereby eliminating any scarring or unseating of the slide bearings during drawer reinsertion.

Another object of the present invention is to provide a cash drawer mountable to linear slides which are mounted to the housing bottom wherein the drawer design allows the use of semitubular rivets rather then shoulder rivets to mount the slides to the housing, thereby decreasing the cost of manufacture.

Another object of the present invention is to provide means for maintaining the position of a cash drawer on linear slides mounted on the housing bottom from which the drawer can be removed wherein the maintaining means provide sufficient float to allow for any imprecision which occurs in mounting the slides on the housing.

Another object of the present invention is to provide a cash drawer with a built-in media space constructed of sufficient size to handle increasing media demands while still maintaining a low profile and accommodating standard sized cash tills, thereby allowing the till to be stored in a standard till safe.

Another object of the present invention is to provide a cash drawer with a media space designed to serve as a guide for the remounting of the cash drawer on the slides.

A still further object of the present invention is to provide a cash drawer with a compartmentalized media space, thereby allowing the sorting of media while further providing increased rigidity to the cash drawer.

A still further object of the present invention is to provide a cash drawer assembly with a bulkhead which serves to both contain the cables of associated peripherals, provide a double wall thickness for undercounter mounting of the assembly, and limit rear access to the drawer latch.

A final object of the present invention is to provide a cash drawer which provides undercounter mounting without additional hardware such as brackets.

SUMMARY OF THE INVENTION

The invention is a cash drawer system having a housing having a bottom; left and right sides, a drawer movable between a closed position in which the drawer is substantially enclosed within the housing and an extended position in which the drawer protrudes from the housing, means for latching the drawer within the housing, means for forcing the drawer toward the extended position, a first drawer slide mounted to the bottom of the housing and comprising first and second rails, the second rail having front and rear portions, the second rail having means for orienting thereon the position of the drawer, the second rail having means located forward of the orienting means for removably latching a drawer thereto, the drawer having a first position orienting means cooperating with the second rail position orienting means to orient the position of the drawer on the second rail, and a first latching means located forward of the first position orienting member of the drawer and cooperating with the latching means of the second rail to removably latch the drawer to the second rail. The drawer may be laterally movable on the slides to accommodate for non-parallel slides. In addition, the central portion of the drawer may be lower than the edges to provide increased media space below a cash till. An interior bulkhead also includes a flange flush with the interior housing to provide a double width wall to secure the drawer in an under-counter configuration.

DETAILED DESCRIPTION

Figure 1:
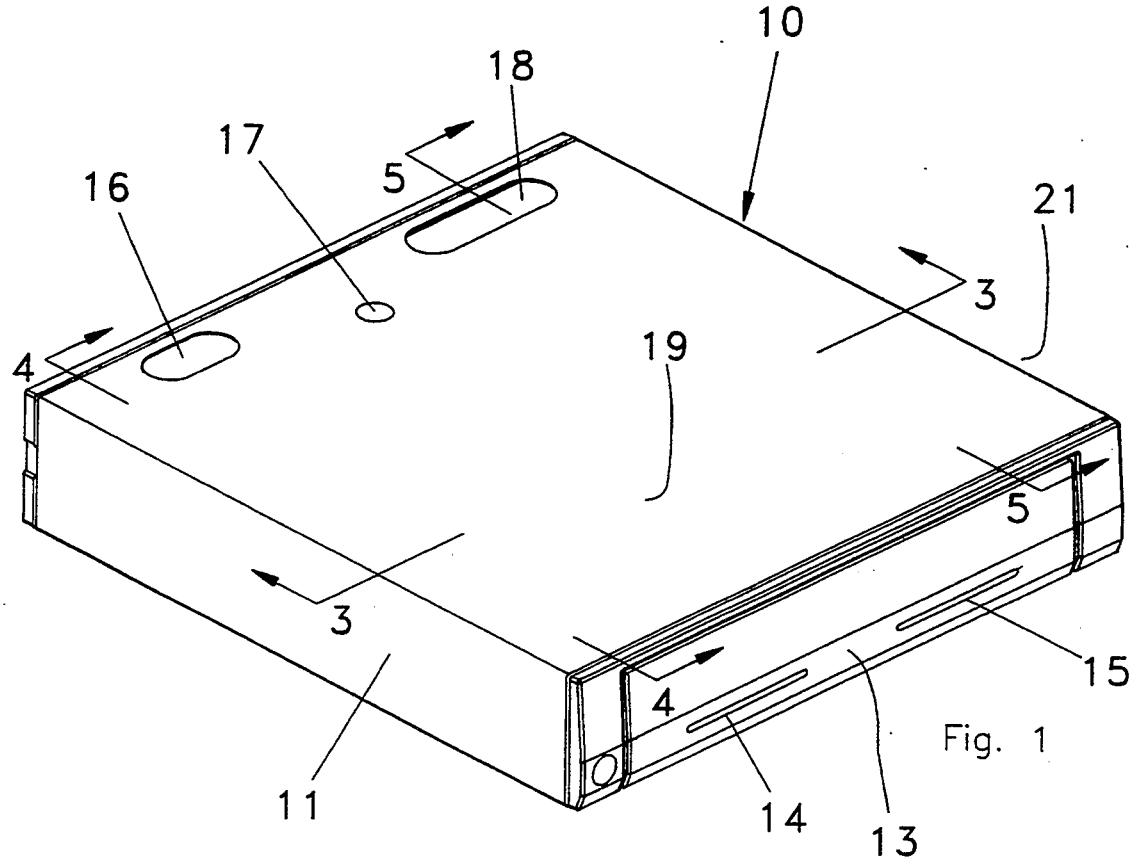
FIG. 1 is a perspective view of one embodiment of a cash drawer system of the present invention.

Referring to FIG. 1, there is shown one embodiment of the cash drawer system of the present invention having a housing, generally designated 10, including left side wall 11, right side wall 21, top wall 19, front wall 12, and peripheral wiring access holes 16, 17, 18. Cash drawer front surface 13 includes media slots 14, 15. In FIG. 1, the cash drawer system is shown in a closed position wherein the cash drawer is substantially enclosed within housing 10. The drawer is movable to an extended position in which the drawer protrudes from the housing.

Figure 2:
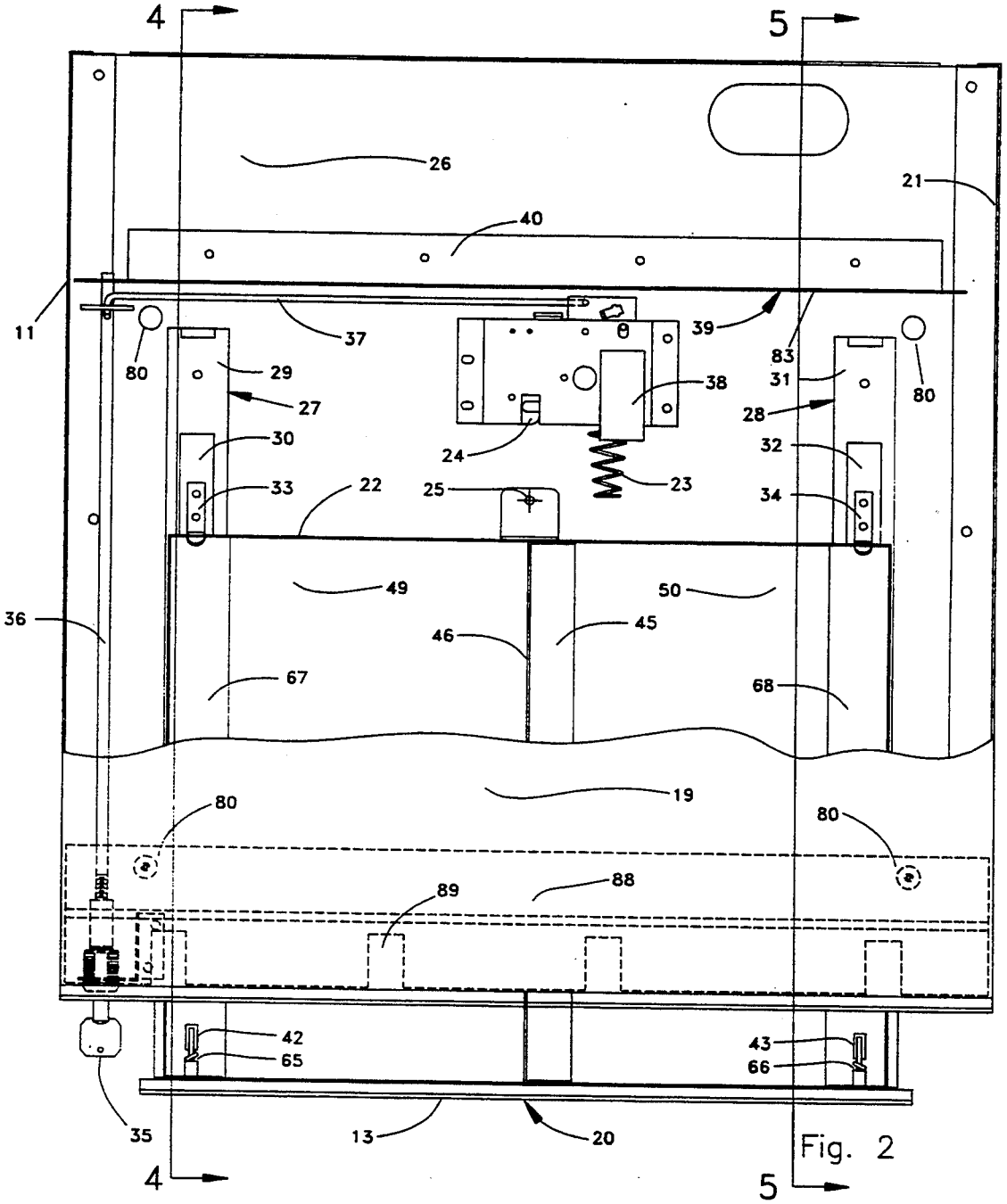
FIG. 2 is a lop view, partially in section, of the embodiment of the cash drawer system of FIG. 1.

Referring now to FIG. 2, there is shown a top view, partially in section, of the embodiment of the cash drawer system of FIG. 1. Cash drawer 20 is shown in a partially extended position. When front surface 13 of cash drawer 20 is pushed with sufficient force, cash drawer 20 is driven into housing 10 and to its closed position shown in FIG. 1, whereby cash drawer back wall 22 contacts and compresses coil spring 23 and latch mechanism 24 engages vertical pin 25 to latch the drawer within housing 10. Coil spring 23 will remain compressed until latch mechanism 24 is opened, at which time coil spring 23 will force cash drawer 20 forward toward an extended position. Alternatively, other means for forcing cash drawer 20 toward an extended position may be used, such as a leaf spring or a solenoid plunger positioned to directly or indirectly provide the pushing force to move drawer 20.

Cash drawer 20 is mounted to housing bottom member 26 by first slide 27 and second slide 28. First slide 27 includes first rail 29 and second rail 30, and second slide 28 includes first rail 31 and second rail 32. First rails 29, 31 are slidably mounted to second rails 30, 32 respectively. To facilitate the relative sliding motion of the rails, slides 27, 28 further respectively comprise ball bearing mechanisms 57,58 well known to those skilled in the art. Second rails 30, 32 each include drawer position orienting members 33, 34 which assist in properly orienting the position of drawer 20 on second rails 30, 32. In one embodiment, each position orienting member 33, 34 comprises a tab, riveted to its respective second rail 30, 32, which extends through a cooperating mating apertures 54, 55 in the back wall 22 of drawer 20.

Latching mechanism 24 may be actuated to latch or unlatch cash drawer 20 by a number of ways well known to those having ordinary skill in the art. For instance, as abstractly shown in the Figures, both a manual keyed mechanism and an electrical actuated mechanism can be utilized. For instance, key 35 rotates rod 36, which is operatively connected to latching mechanism 24 by rod 37. Alternatively, solenoid 38, which is responsive to electrical signals received through cables (not shown) connected to peripheral or point of sale equipment, may actuate latching mechanism 24. Latching mechanism 24 and solenoid 38 are mounted adjacent metal bulkhead 39, which extends from housing bottom member 26 to the interior housing top. Rearwardly extending flange 40 extends perpendicularly from the bottom edge of vertically extending first portion 83 of bulkhead 39 and is attached to housing bottom member 26 through means such as spot welding or rivets.

Figure 3:
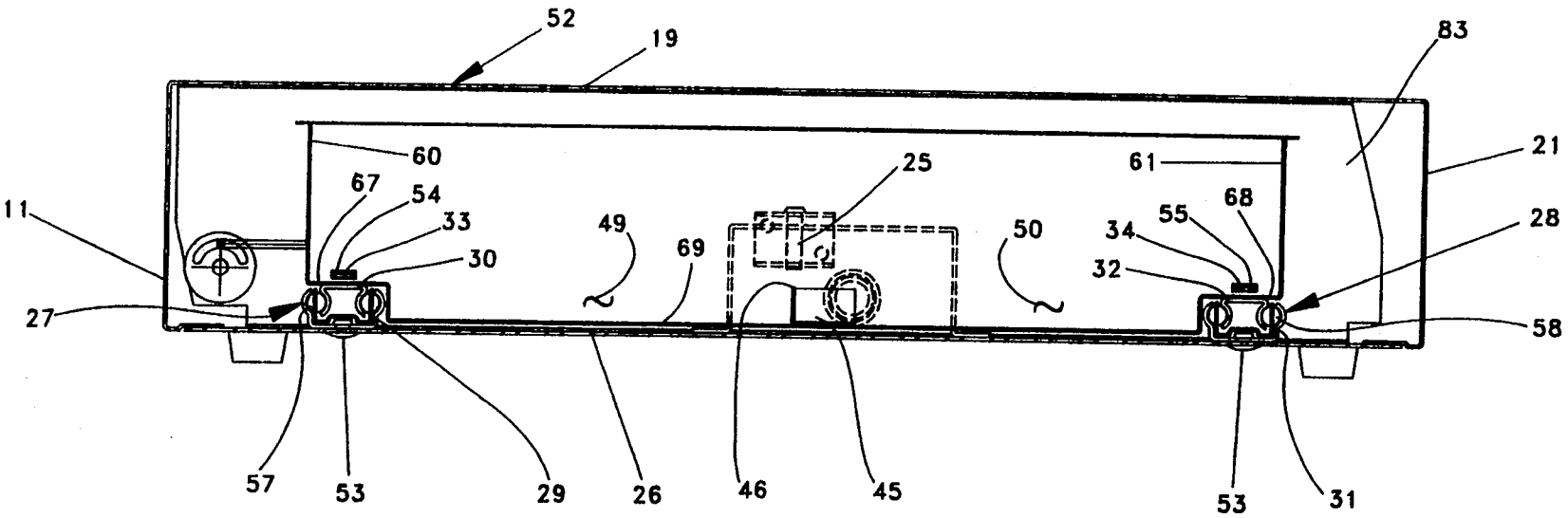
FIG. 3 is a front sectional view taken through line 3—3 of FIG. 1.

Drawer 20 is latched to second rails 30, 32 by pivotable latch members 65, 66, which extend through apertures 42, 43 in cash drawer 20, as well as mating apertures 44 in second rails 30, 32. Drawer 20 further includes intermediate member 45, which may be formed by an L shaped bracket being spot welded or riveted to a bottom surface of drawer 20. As shown in FIG. 3, intermediate member 45 includes a top edge 46 which is substantially planar with first 67 and second 68 interior bottom upwardly-facing surfaces of cash drawer 20. Intermediate member 45 improves the overall structural integrity of drawer 20. Intermediate member 45 also functions to divide a central portion of the bottom of drawer 20 into first 49 and second 50 media compartments which are respectively accessible through media slots 14, 15 even when a cash till is received in drawer 20. Slides 27, 28 may be mounted to the downwardly-facing surfaces opposing the faces of first 67 and second 68 interior bottom upwardly-facing surfaces of cash drawer 20 to thereby provide a connecting means between drawer 20 and housing 10.

Referring now to FIG. 3, housing 10 includes two primary components, namely, a one-piece wraparound cover member 52 which forms left side wall 11, top wall 19, and right side wall 21, as well as bottom member 26. Both members may be stamped from 18 gauge sheet metal, and cover member 52 may be secured to bottom member 26 by screws (not shown) disposed along the contacting areas located at the left and right edges of bottom member 26. It will be appreciated from FIG. 3 that first rails 29, 31 of slides 27,28 respectively may be rigidly and securely mounted to housing bottom member 26 by semitubular rivets 53. Semitubular rivets provide a less expensive and more rigid :fastening system than other forms of rivets, such as shoulder rivets. Tabs 33, 34, which respectively extend from second rails 30, 32, assist in orienting, drawer 20 with respect to second rails 30, 32 by virtue of cooperating orienting members, such as apertures 54, 55 in back wall 22 of drawer 20. However, it will be readily apparent to those of skill in the art that alternate embodiments of the cooperating drawer position orienting means disclosed in FIG. 3 may be employed. For example, if second rails 30, 32 were designed with a sufficient height extending above first rails 29, 31, orienting members 33, 34 could extend laterally (instead of upwardly) from second rails 30, 32. In addition, laterally extending orienting members 33, 34 could be, employed in slides constructed wherein a second rail, to which drawer 20 engages, is the wider rail and mates over a narrower first rail fastened to housing bottom member 26. It would also be possible to mount slides 27, 28 in positions rotated 90 degrees from the positions shown in FIG. 3. Obviously, with any of the foregoing variations, the location of mating apertures or other cooperating position orienting means on drawer 20 would be moved to mate with the cooperating position orienting means of second rails 30, 32.

As may be further appreciated from FIG. 3, slides 27, 28 are essentially mounted beneath a portion of drawer 20. As such a construction allows, for a given width of space, a wider cash drawer than a system which utilizes slides mounted to the opposing exterior sides of the drawer, the cash drawer system of the present invention is particularly beneficial in applications where lateral countertop splice is limited. The present invention provides a cash drawer system wherein the bottom of drawer 20 includes first 67, second 68, and third 69 interior bottom upwardly-facing surfaces. First surface 67 is disposed adjacent left drawer wall 60 and second surface 68 is disposed adjacent right drawer wall 61. While the first 67 and second 68 surfaces are abutting drawer walls 60, 61 in the embodiment shown in FIG. 3, other embodiments wherein additional drawer bottom surfaces of different heights are positioned therebetween are within the scope of the present invention. The configuration of FIG. 3 permits a cash till 62 to be positioned within drawer 20 so that its left and right bottom sides engage surfaces 67, 68 respectively, and its bottom intermediate portion is supported by top edge 46 of intermediate member 45. It will also be recognized by those of skill in the art that the disclosed drawer may be used with existing cash tills constructed to provide media space below them by incorporating downwardly extending flanges along the left and right edges of the cash till. However, the present invention allows for even greater media space when used with such cash tills, as the portion of drawer 20 intermediate slides 27, 28 is lower than first 67 and second 68 interior bottom upwardly-facing surfaces. This space between slides 27, 28 is not wasted as in many prior systems employing bottom mounted slides, but instead, much of the space is used as media space interior to the drawer. Thus, the present design permits either a cash drawer system having a lower profile than systems in the prior art for a given height of media space, or alternatively, more media space for identical height profiles. This design consideration is particularly important in view of the significant height of other peripheral equipment, such as printers, monitors, display or bar code scanners, that are frequently placed on top of a cash drawer systems.

Those skilled in the art will also appreciate that the drawer configuration disclosed in FIG. 3 is self-aligning during its insertion into housing 10. Specifically, both rails of slides 27, 28 constantly remain mounted within housing 10, even when drawer 20 is removed. Because the portion of the bottom of drawer 20 comprising the third interior bottom upwardly-facing surface 69 fits between slides 27, 28, approximate proper horizontal positioning of cash drawer 20 is easily obtained by so positioning this portion of the drawer. For the embodiment shown in FIG. 3, as drawer 20 is slid rearwardly along second rails 30, 32 during drawer insertion, orienting members 33, 34 of second rails 30, 32 will insert in drawer back wall apertures 54, 55. Orienting members 33, 34 are constructed slightly narrower in width than the width of apertures 54, 55. In addition, the cooperating latching means between drawer 20 and second rails 30,32 described below, in one embodiment are also appropriately sized to permit drawer 20 to be slightly laterally moveable while positioned, and even latched, on slides 27, 28. In one embodiment the amount of lateral play ("float") may be 0.015 inch (0.038 cm.) to each side from true center. This capability offers significant advantages over the prior art. Specifically, although manufacturers attempt to align and mount cash drawer slides to the housing so that the slides are perfectly parallel, such exact alignment is time consuming and costly to achieve. If such slides are non-parallel they can significantly impair the case with which the drawer slides into and out of the housing and contribute to further future misalignment or cause racking or binding. Moreover, even if the slides are perfectly aligned to be parallel during manufacturer, they frequently become misaligned during shipping or after repeated use, as cash drawers are repeatedly opened and slammed shut during each working day. However, because the present invention allows the cash drawer to laterally shift or "float" on slides 27, 28, the slides will freely extend and retract even if not exactly parallel. Consequently, the lateral shifting capability of the drawer reduces the amount of precision necessary during manufacture in aligning the slides to be parallel, which in turn reduces labor and manufacturing costs. In addition, some prior art systems have attempted to partially resolve the non-parallel slide problem, at least in cash drawers in which the drawer is side mounted (as opposed to bottom mounted) to the housing, by utilizing more expensive shoulder rivets which give the slides a small degree of play with respect to the housing. However, the existence of this play can actually contribute to misalignment of the slides over time. Moreover, these rivets are expensive. However, the present invention allows inexpensive semitubular rivets to be used to mount the slides to the housing, thereby decreasing manufacturing cost even further.

Figure 4:
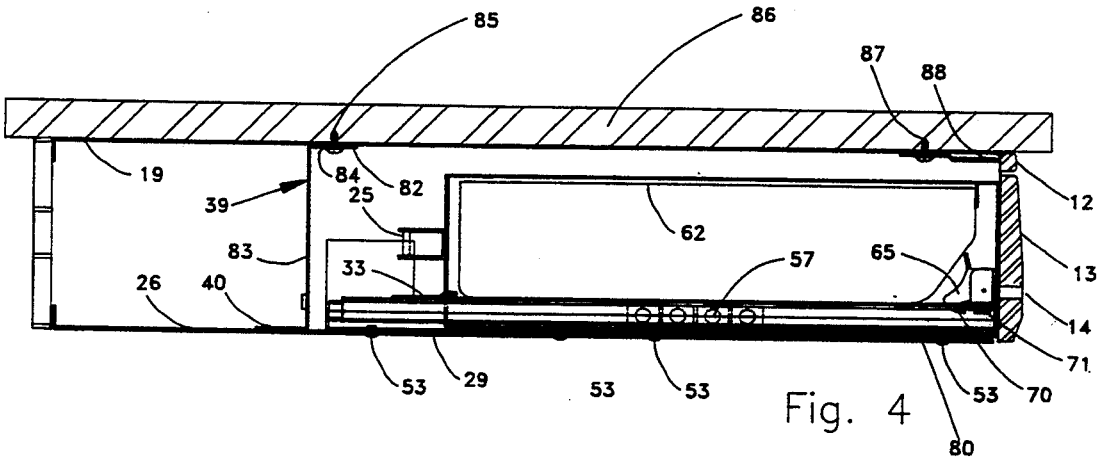
FIG. 4 is a side sectional view taken through line 4—4 of FIG. 1, wherein the cash drawer system is mounted to the underside of a counter.

Referring now to FIG. 4, drawer 20 is shown in its retracted position substantially enclosed within housing 10. Pivotable latch 65 is shown in its engaged position wherein it extends through cash drawer aperture 42 and mating aperture 44 in second rail 30 to thereby latch the drawer to second rail 3(I. One feature required of most cash drawers is that the cash drawer be removable from the housing. Some prior systems provide this capability by including a rotatable latch positioned behind the back of the drawer which contacts a downwardly extending portion of the front portion of the housing to prevent the cash drawer from being inadvertently withdrawn from the housing. As the rotatable latch is rotated, it is lowered so that it is fully below the downwardly extending portion of the front portion of the housing. Drawer removal is then possible. However, this type of configuration is cumbersome in practice. The user must extend the user's hand entirely to the back of the cash drawer to actuate the latch.

As is apparent from FIG, 4, the present invention solves this problem by providing a drawer latching mechanism located at the front of the drawer. Specifically, when cash till 62 is received within drawer 20, a small partially-curved area of space remains forward the front of the cash till wherein pivotable latch member 65 is positioned. To remove cash drawer 20, the user merely removes the cash till, depresses the upper portion of latch 65 (and latch 66) to pivot and raise hook portion 70 above second rail 30, and then pulls drawer 20 forward. To reinsert drawer 20 into housing 10, the user merely positions the portion of the bottom of drawer 20 comprising the third interior bottom upwardly-facing surface 69 between slides 27, 28, slides the drawer back until apertures 54, 55 in back wall 22 of drawer 20 mate with orienting members 33, 34, and hold-down rivet 71 is inserted into receiving notch 72. During this process, the rearward (ramped) surfaces of hook portions 70 will be pushed upward by the forward edge of second rails 30, 32 until hook portions 70 are above second rails 30, 32, then they will snap into mating apertures 44 to thereby latch drawer 20 to second rails 30, 32. Hold down rivets 71, wider at their bottoms than receiving notch 72, act against second rails 30, 32 to prevent upward movement of drawer 20.

Visible in FIG, 4, mounting access holes 80 are present in bottom member 26 of housing 10. These holes are utilized to assist the under counter system installation configuration as shown in FIG. 4. Upper flange 82 extends perpendicularly from the top edge of vertically extending first portion 83 of bulkhead 39 and is flush with top wall 19 of housing 10. Upper flange also includes aperture 84 into which screw 85 is inserted to tighten housing 10 against counter 86. A screwdriver (not shown) may be inserted through access hole 80 to assist in installing screw 85. Due to the unique and inventive configuration of bulkhead 39, and in particular flange 82, a double thickness of metal is provided at the point where screw 85 provides attachment to counter 86. This configuration allows a thinner metal, such as 18 gauge steel, to be used to construct the housing, which decreases both the manufacturing cost and the weight of the completed unit. Similarly, reinforcing metal member 88, positioned forward of bulkhead 39 near housing front wall 12, provides a double thickness for screw 87, which provides a forward attachment of the cash drawer system to counter 86. Reinforcing metal member includes access holes 89 (seen in FIG. 2) which are used in mounting front wall 12 to cover member 52. Reinforcing metal member 88 also includes a stepped taper to force any upwardly projecting cash till 62 downward when drawer 20 is moved towards its extended position, thereby preventing cash till 62 from hindering the drawer extension.

Figure 5:
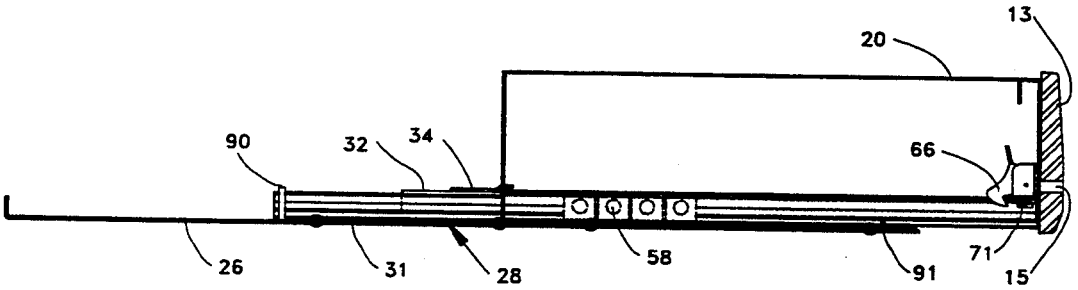
FIG. 5 is another side sectional view of the cash drawer and slides taken through line 5—5 of FIG. 1.
Figure 6:
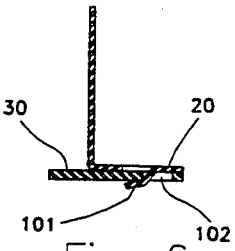
FIG. 6 is a partial view of a slide and cash drawer of the present invention with an alternate embodiment of an orienting means.

Referring now to FIG. 5, another view is shown of first rail 31 and second rail 32 of second slide 28, as well as outwardly extending orienting member 33. First rail 31 (and first rail 29) includes rearward stop means 90 and forward stop means 91. Rearward stop means 90 contacts and prevents second rail 32 from excessive retraction of drawer 20 as it is pushed into the housing. Forward stop means 91 contacts bearing mechanism 58 to prevent second rail 32 from excessive projection.

Figure 7:
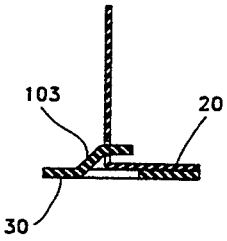
FIG. 7 is a partial view of a slide and cash drawer of the present invention with another alternate embodiment of an orienting means.
Figure 8:
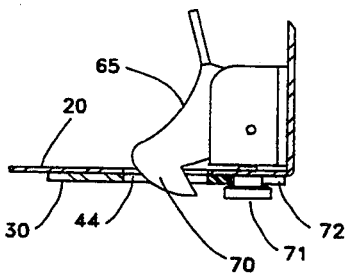
FIG. 8 is a partial view of a slide and cash drawer of the present invention with a latching means between the cash drawer and slide as shown in the embodiment of the cash drawer system of FIG. 1.
Figure 9:
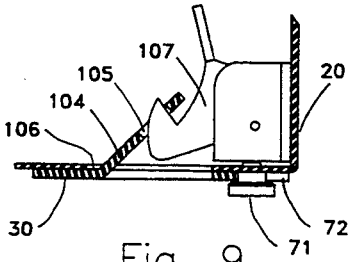
FIG. 9 is a partial view of a slide and cash drawer of the present invention with an alternate embodiment of a latching means between the cash drawer and slide.

As is plainly evident from FIGS. 6–10, many other configurations of orienting and latching means are within the scope of the present invention. For example, in FIG. 6, drawer 20 is provided with an outwardly extending drawer position orienting member 101 which cooperates with mating aperture 102 in second rail 30. An alternate embodiment is shown in FIG. 7 wherein outwardly extending drawer position orienting member 103 is stamped from the same metal piece from which second rail 30 is constructed, rather than being a separate metal piece riveted to rail 30.

Likewise, many variations of latching mechanisms, disposed forward of the orienting members on the drawer and second rail, are possible. The pivotable latch described above is shown in greater detail in FIG. 8. An alternate embodiment, shown in FIG. 9, contemplates a cooperating latch member 104, with aperture 105, that outwardly extends from second rail 30 through aperture 106 in drawer 20. Aperture 105 of latching member 104 is positioned to receive a cooperating pivotable latching member 107 affixed to drawer 20.

Figure 10:
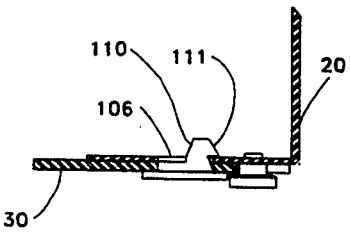
FIG. 10 is a partial view of a slide and cash drawer of the present invention with another alternate embodiment of a latching means between the cash drawer and slide.

Yet another embodiment is disclosed in FIG. 10. Specifically, second rail 30 includes an opening fitted with sin outwardly extending plastic latch 110, which extends through mating aperture 106 to latch drawer 20 to second rail 30. When front surface 111 of plastic member 110 is pushed rearward, the front of drawer 20 may be lifted upward to unlatch drawer 20 from second rail 30.

It will be appreciated by those of skill in the art that the present invention provides numerous advantages over existing cash drawer systems. Because of the ability of its drawer to move with respect to the slides, the invention cash drawer system does not suffer from racking, binding or difficulty in drawer movement resulting from misaligned rails. The cash drawer may be easily unlatched by a user by accessing latches conveniently provided in the front of the drawer, without the necessity of inserting one's hand into the housing of the cash drawer. Furthermore, the unique configuration of the drawer bottom provides a cash drawer which aids its own alignment on the rails. This self-alignment feature makes the drawer easier to mount upon the rails as well as decreases scarring of the front surface of the housing resulting from accidentally banging it with the back of the drawer while attempting to insert the drawer into the housing. Moreover, the interior bulkhead, with a flange including mounting holes, increases the structural integrity of the cash drawer system, thereby allowing thinner materials to be used to construct the housing while still providing secure attachment in under counter installation. Racking and binding problems are also eliminated by attaching the slides beneath the drawer instead of to the sides of the drawer, which also allows either a wider cash drawer to be used or a narrower housing to be used. Moreover, the inventive cash drawer system disclosed herein provides increased media space within the cash drawer while still accommodating standard sized cash tills, provides separate media compartments, and increases the structural integrity of the cash drawer.

While a commercial embodiment of the cash drawer system of the present invention has been shown and described, it will be understood by those of skill in the art that the same is capable of modification without departure from the spirit and scope of the invention, as defined in the claims.

What is claimed is:

1. A cash drawer system comprising:

a housing having a bottom, left and right sides, means for latching a drawer within the housing, and means for forcing a drawer to extend from the housing, a drawer movable between a closed position in which the drawer is substantially enclosed within the housing and an extended position in which the drawer protrudes from the housing, the drawer being removably mounted to the housing, the drawer comprising:

a left side and a right side, a first interior bottom upwardly-facing surface disposed adjacent the drawer left side, a second interior bottom upwardly-facing surface disposed adjacent the drawer right side, and a third interior bottom upwardly-facing surface disposed intermediate the first and second interior bottom upwardly-facing surfaces such that the third interior bottom upwardly-facing surface is lower than the first and second interior bottom upwardly-facing surfaces, such that the first and second interior bottom upwardly-facing surfaces may support a cash till, and first and second drawer slides disposed below the first interior bottom upwardly-facing surface and the second interior bottom upwardly-facing surface respectively, the first and second drawer slides disposed lateral to the third interior bottom upwardly-facing surface, each slide comprising first and second rails, each first rail being mounted to the housing.

2. The cash drawer system of claim 1, wherein the drawer further comprises a front wall having at least one media slot disposed intermediate the first and second interior bottom upwardly-facing surfaces of the drawer.

3. The cash drawer system of claim 1, wherein the first interior bottom upwardly-facing surface abuts the left side of the drawer and the second interior bottom upwardly-facing, surface abuts the right side of the drawer.

4. The cash drawer system of claim 1, wherein the drawer further comprises a bottom, and wherein each second rail is connected to the drawer.

5. The cash drawer system of claim 4, wherein the drawer bottom includes downwardly-facing surfaces opposing the interior bottom upwardly-facing surfaces, and wherein the second rail of the first slide is mounted to the downwardly-facing surface opposing the face of the first interior bottom upwardly-facing surface, and the second rail of the second slide is mounted to the downwardly-facing surface opposing the face of the second interior bottom upwardly-facing surface.

6. The cash drawer system of claim 1 wherein each of the second rails includes an outwardly extending drawer position orienting member, and wherein the drawer includes first and second drawer position orienting members cooperating with the respective second rail drawer position orienting members to thereby orient the position of the drawer relative to both of the second rails.

7. The cash drawer system of claim 1 wherein each of the second rails includes a latching aperture, and wherein the drawer includes first and second latching members cooperating with the respective latching apertures of the second rails to thereby latch the drawer to the second rails.

8. The cash drawer system of claim 1, wherein the drawer further comprises a back wall, a front wall and an intermediate member extending from the front wall of the drawer to the back wall of the drawer and located intermediate the first and second interior bottom upwardly-facing surfaces.

9. The cash drawer system of claim 8, herein a top of the intermediate member is substantially planar with the first and second interior bottom upwardly-facing surfaces.

10. The cash drawer system of claim 8 wherein the front wall comprises at least one media slot disposed on each side of the intermediate member.

* * * * *